United States Patent [19]

Ota

[11] Patent Number: 4,852,752

[45] Date of Patent: Aug. 1, 1989

[54] NECK STRUCTURE OF SYNTHETIC RESIN BOTTLE-SHAPED CONTAINER

[75] Inventor: Akiho Ota, Tokyo, Japan

[73] Assignee: Yoshino Kogyosho Co., Ltd., Tokyo, Japan

[21] Appl. No.: 208,862

[22] Filed: Jun. 14, 1988

Related U.S. Application Data

[63] Continuation of Ser. No. 93,120, Sep. 2, 1987, abandoned, which is a continuation of Ser. No. 839,506, Mar. 14, 1986, abandoned.

[51] Int. Cl.[4] ..... B65D 1/02

[52] U.S. Cl. ..... 215/31; 215/324

[58] Field of Search ..... 215/31, 252, 324, 327

[56] References Cited

U.S. PATENT DOCUMENTS

| | | | |
|---|---|---|---|
| 1,287,191 | 12/1918 | Bernardin | 215/324 |
| 1,796,728 | 3/1931 | Sharp | 215/324 |
| 2,104,236 | 1/1938 | Mermer | 215/252 |
| 2,175,350 | 10/1939 | Hammer | 215/252 |
| 3,901,403 | 8/1975 | Menke | 215/251 |

FOREIGN PATENT DOCUMENTS

| | | | |
|---|---|---|---|
| 48923 | 6/1934 | Denmark | 215/252 |
| 195624 | 4/1965 | Sweden | 215/252 |

*Primary Examiner*—Donald F. Norton

*Attorney, Agent, or Firm*—Parkhurst, Oliff & Berridge

[57] ABSTRACT

A neck structure for a bottle-shaped container formed of synthetic resin, and associated with a rolled cap member having a top-closed cylindrical shape and constructed of thin aluminum plate at a cylindrical neck portion of the bottle-shaped container. The cylindrical neck portion has threads circumferentially formed on the outer periphery of the upper end of the cylindrical neck portion; at least one thick cylindrical portion of relatively large diameter is formed between the upper end of the cylindrical neck portion and the lower end of the cylindrical neck portion. The connecting portion is formed with a plurality of longitudinal strips on the outer periphery thereof and recesses between the longitudinal strips. The neck structure of the synthetic resin bottle-shaped container is constructed to be adapted to be associated with a tamper-proof-cap such that the lower end of the tamper-proof-cap is relatively increased in height.

6 Claims, 1 Drawing Sheet

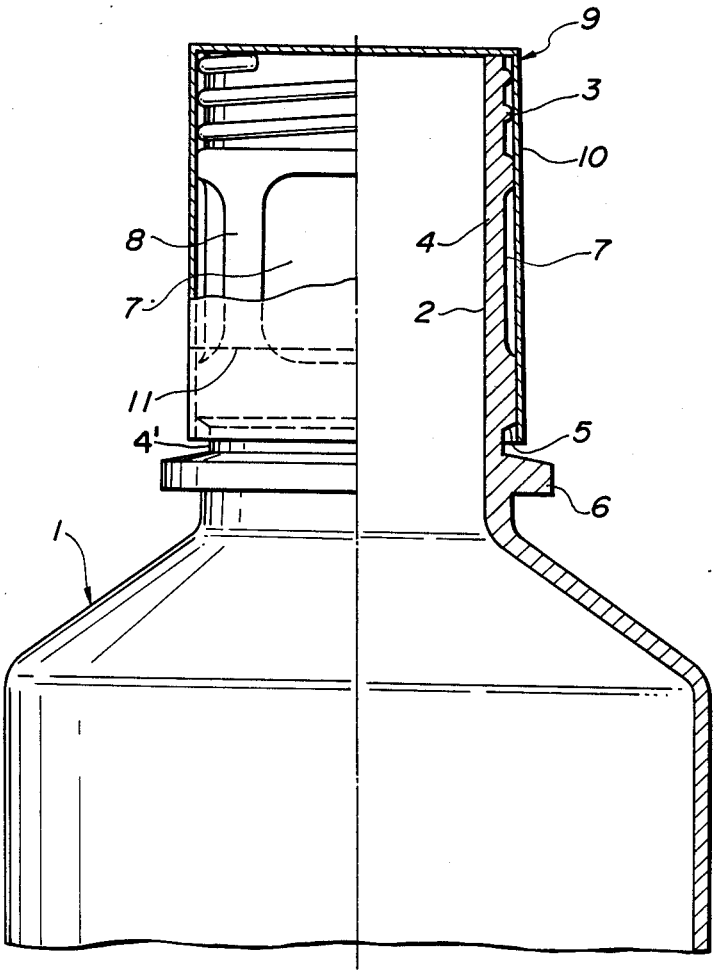
9
3
10
8
4
7
7
2
11
4'
5
6
1

NECK STRUCTURE OF SYNTHETIC RESIN BOTTLE-SHAPED CONTAINER

This is a continuation of application Ser. No. 093,120 filed Sept. 2, 1987, now abandoned, which in turn is a continuation of application Ser. No. 839,506, filed Mar. 14, 1986, now abandoned.

BACKGROUND OF THE INVENTION

This invention relates to a neck structure of a synthetic resin bottle-shaped container and, more particularly, to a cap of the bottle-shaped container, constructed to enhance the decoration of a rolled on cap of thin aluminum plate called "a pilfer-proof-cap" or tamper proof cap.

Caps which are fabricated by engaging a top-closed cylindrical cap blank of thin aluminum plate with the neck of a bottle-shaped container from above, then crimpling the body of the cap blank along the outer peripheral shape of the neck, and associating the cap with the neck, called generally "a tamper-proof-cap" have been widely employed in a large quantity in a number of fields.

This tamper-proof-cap is constructed by engaging the cap with the neck of a bottle-shaped container from above, then pressing to deform the cylindrical portion to the outer periphery of the neck formed with threads thereby press-molding spiral grooves to be engaged with the threads, bending the lower end inward to engage the lower end with the lower step of a cylindrical portion formed in a large thickness formed directly under the threads from below, and further forming a notched line of perforations between the portion to be engaged with the cylindrical portion from below and the portion formed with the spiral grooves.

Since the tamper-proof-cap is constructed as described above, the notched line of perforations must be broken so as to open a bottle-shaped container having the aforementioned neck and cap structure.

Therefore, a consumer can identify that a sealed bottle-shaped container is not illegally opened but held in a sealed state by confirming the no breakage of the notched line of perforations of the tamper-proof-cap, and can purchase the bottle-shaped container of a commodity with safety.

The tamper-proof-cap can thus perform various excellent effects, but though the conventional tamper-proof-cap of this type employs a thin aluminum plate of extremely high decorativeness, the cap does not have a construction and functions to achieve this high decorativeness.

Since the cap is molded in the final shape by press molding, even if the surface is treated to have a decoration, the surface is deteriorated by the press deformation, and this deteriorates the external appearance of the cap.

However, the tamper-proof-cap is press deformed only at the portion opposed to the threads on the neck of a bottle-shaped container and a portion opposed to the lower end of a cylindrical portion, but the other portions are not necessarily deformed at all. It is considered to provide a cylindrical portion having a relatively large width between the upper end of the neck and the lower end of the neck for engaging the cap and to surface treat the surface of the cylindrical portion to have a decorative effect.

SUMMARY OF THE INVENTION

Accordingly, it is an object of this invention to provide a neck structure of a synthetic resin bottle-shaped container constructed to be adapted to be associated with a tamper-proof-cap of a new structure in such a manner that the lower end of the tamper-proof-cap is relatively increased in the longitudinal width of a thick cylindrical portion for forming an engaging step for engaging the lower end of the tamper-proof-cap from below.

The foregoing object and other objects as well as the characteristic features of the invention will become more fully apparent and more readily understandable by the following description and the appended claims when read in conjunction with the accompanying drawing.

BRIEF DESCRIPTION OF THE DRAWING

The FIGURE is a partial longitudinal sectional view of an embodiment of a neck structure of a bottle-shaped container according to this invention.

DESCRIPTION OF THE PREFERRED EMBODIMENTS

An embodiment of a neck structure of a bottle-shaped container according to this invention will now be described in detail with reference to the accompanying drawing.

A neck structure of a synthetic resin bottle-shaped container according to this invention is constructed by forming threads 3 on the outer periphery of the upper end of a relatively long cylindrical neck portion or medial portion 2 of a blow-molded bottle-shaped container 1 of a biaxially oriented thermoplastic synthetic resin such as polyethylene terephthalate resin, forming a thick cylindrical portion 4 on a relatively wide medial cylindrical portion extending between the upper end formed with the threads 3 and a lower end circumferentially formed with a flange 6, the thick cylindrical portion being separated from the lower end by a smaller diameter lower cylindrical portion 4', and forming a plurality of recesses 7 with a plurality of longitudinal strips 8 remaining on the outer periphery of the cylindrical portion 4.

The recesses 7 formed on the outer periphery of the cylindrical portion 4 reduce the consumption amount of expensive thermoplastic synthetic resin material such as polyethylene terephthalate resin and prevent the external shape from deforming due to a sinking phenomenon on the thick (in terms of wall thickness) connecting portion 4.

The widths of the recesses 7 along the circumferential direction are not so large, but have a size of approx. $\frac{1}{4}$ of the circumference. The remaining longitudinal strips 8 from the recesses 7 thus formed on the neck cylindrical portion 2 are disposed on an imaginary single peripheral surface of the connecting portion 4 before the surface formed with recesses 7.

Since the neck structure of this invention is thus constructed, a tamper-proof-cap to be associated with the neck of this invention may employ, as shown, a cap blank 9 of the structure having a cylindrical wall including a relatively longitudinally long top-closed cylindrical shape.

The cylindrical wall 10 of the cap blank 9 is molded with an inner diameter slightly larger than the outer diameter of the cylindrical portion 4 and the threads 3.

The cap blank is engaged and associated with the neck cylindrical portion 2 from above, press deformed to a tamper-proof-cap by a known method, and simultaneously associated with the neck cylindrical portion 2, and sealed and held on a bottle-shaped container 1.

More particularly, the cap blank 9 is press molded only at the upper end of the cylindrical wall 10 adjacent the threads 3 and the lower end of the cylindrical wall 10 adjacent the engaging step 5 to form an inward flange portion of the and the cylindrical wall 10 adjacent the connecting portion 4 is not press deformed at all, nor affected by any working force.

Therefore, a decorative pattern and/or characters may be formed on the portion of cylindrical wall 10 which is adjacent the connecting portion 4 of the cap blank 9 to be effectively displayed without deteriorating the pattern and the characters.

Since the cap blank 9 is formed of a thin aluminum plate known per se, excellent decorative effect of aluminum can be displayed on the pattern and the character, thereby performing excellent displaying capacity.

Further, since a notched line of perforations 11 may be formed on any portion of the cylindrical wall 10 below the upper end adjacent the threads 3, the notched line of perforations may be formed freely on any portion such as a portion to be readily opened, a portion readily identified for opening the seal to respond to the requirement of production.

Since the bottle-shaped container 2 is made of synthetic resin as described above, its material cost is high and it is economically desirable to eliminate unnecessary portions as much as possible. In case of this invention, since the connecting portion 4 is formed with the recesses 7 from which the material is removed, the quantity of the synthetic resin material necessary to mold one bottle-shaped container is reduced.

Further, since longitudinal strips 8 are disposed on the outer periphery, of the connecting portion 4 formed with the recesses 7, the lower end opening of the cap blank 9 to be associated in case of associating the cap blank 9 with the neck cylindrical portion 2 from above is guided by the strips 8.

Further, since the wide recesses 7 are formed on the thick connecting portion 4, no depression peculiar to thick synthetic resin molding products occurs in the connecting portion 4 thus permitting preferable external appearance and high molding dimensional accuracy.

According to this invention as described above, the neck structure of the bottle-shaped container thus constructed can associate a tamper-proof-cap of high decorative effect, sufficiently reduce the increase in synthetic resin material to be consumed in molding, can provide preferable external appearance without occurrence of depression and high dimensional accuracy, further stabilize the association of the cap blank, and reliably perform the molding of the neck structure.

What is claimed is:

1. A neck structure of a bottle-shaped container which includes a cylindrical neck portion adapted for association with a rolled on cap member constructed of thin aluminum plate and having a top-closed cylindrical shape, said cylindrical neck portion comprising:

an upper end having threads circumferentially formed on an outer peripheral portion of said upper end;

a lower end having a flange circumferentially formed on an outer peripheral portion of said lower end;

a long, thick upper cylindrical portion extending below said upper end and having a diameter;

a lower cylindrical portion having a smaller diameter than said diameter of said upper cylindrical portion between said upper cylindrical portion and said lower end;

a plurality of circumferentially spaced recesses formed in said upper cylindrical portion;

a plurality of circumferentially spaced longitudinal strips formed between said circumferentially spaced recesses, an outer surface of said circumferentially spaced longitudinal strips being disposed on an imaginary single peripheral surface of said upper cylindrical portion which extends radially outward of the surface of said recesses; and a circumferential engaging step formed between a lower circumferential surface of said upper cylindrical portion and said lower cylindrical portion, said engaging step being adapted for engagement with a rolled engaging portion of said rolled on cap member by inwardly bending the lower end of said rolled engaging portion of said rolled on cap member to form an inward flange.

2. The neck structure of a bottle shaped container of claim 1, wherein said threads have an outermost diameter and said long thick, cylindrical portion has an outer diameter which is greater than or equal to the outermost diameter of said threads.

3. The neck structure of a bottle shaped container of claim 1, wherein said long, thick cylindrical portion has a circumference, and each of said plurality of circumferentially spaced recesses has a circumferential width which is no more than $\frac{1}{4}$ of the circumference of said long, thick cylindrical portion.

4. A neck structure of a bottle shaped container, said neck structure comprising a cylindrical neck portion, said cylindrical neck portion comprising:

an upper cylindrical portion having an outer periphery;

threads formed on the outer periphery of said upper cylindrical portion, said threads having an outermost diameter;

a medial cylindrical portion, said medial cylindrical portion having an outer diameter which is greater than or equal to the outermost diameter of said threads, wherein the length of said medial cylindrical portion is greater than the length of said upper cylindrical portion;

a plurality of circumferentially spaced recesses formed in said medial cylindrical portion such that a plurality of circumferentially spaced longitudinal strips are formed between said circumferentially spaced recesses; and a lower circumferential engaging step portion adapted for engagement with a rolled engaging portion of said rolled on cap member.

5. The neck structure of a bottle shaped container of claim 4, wherein the length of said medial cylindrical portion is at least twice as great as the length of the upper cylindrical portion.

6. The neck structure of a bottle shaped container of claim 4, wherein the circumferentially spaced longitudinal strips have a length defined by the longitudinal extent of the circumferentially spaced longitudinal strips and a width defined by the circumferential extent of the longitudinal strips, and wherein said width is less than the length of said longitudinal strips.

* * * * *